US006267151B1

(12) United States Patent
Moll

(10) Patent No.: US 6,267,151 B1
(45) Date of Patent: Jul. 31, 2001

(54) METHOD OF MAKING A PATTERNED GLASS FABRIC

(75) Inventor: Andre Moll, Bayreuth (DE)

(73) Assignee: Vitrulan Textilglas GmbH, Marktschorgast (DE)

( * ) Notice: Subject to any disclaimer, the term of this patent is extended or adjusted under 35 U.S.C. 154(b) by 0 days.

(21) Appl. No.: 09/377,603

(22) Filed: Aug. 19, 1999

(30) Foreign Application Priority Data

Aug. 20, 1998 (DE) ..... 198 37 825

(51) Int. Cl.[7] ..... D04B 15/84; D03D 15/00; D06N 7/00

(52) U.S. Cl. ..... 139/420 C; 428/904.4; 428/920

(58) Field of Search ..... 139/420 C; 428/904.4, 428/920

(56) References Cited

U.S. PATENT DOCUMENTS 4,677,016 * 6/1987 Ferziger et al. ..... 428/212
5,433,997 * 7/1995 Land ..... 428/251

FOREIGN PATENT DOCUMENTS 198 37 825 * 4/2000 (DE) .
0 980 921 A * 6/1999 (EP) .

* cited by examiner

*Primary Examiner*—Andy Falik
(74) *Attorney, Agent, or Firm*—Jordan and Hamburg LLP

(57) ABSTRACT

A method for the production of a patterned glass fabric, especially for wallpaper or similar materials having a fabric woven with glass fiber yams, in which glass fiber yams are processed on a pattern-controlled Jacquard loom, a glass fiber yam with a titer between 130 tex and 150 tex, and preferably between 139 and 142 tex, being used for the warp, and a glass fiber yarn with a titer between 190 tex and 400 tex, and preferably of 215 tex, being used for the filling, the fluctuations in titer being less than ±10%, and preferably ±7%.

18 Claims, No Drawings

METHOD OF MAKING A PATTERNED GLASS FABRIC

BACKGROUND OF THE INVENTION

The invention relates to a method for the production of a patterned glass fabric, especially for wallpaper or similar materials having a fabric woven with glass fiber yarns.

Dobby looms have already been used for many decades in order to produce glass fabrics. This is true also for the production of fabric woven with glass fiber yarns, which is also customary for more than 25 years. However, a patterned fabric cannot be produced with the help of such dobby looms. This, does not matter for glass fabrics, which are to be inserted in plastic components for reinforcing purposes. It is different, however, for fabric of glass fiber yarns, for which one would like to have woven-in patterns. However, such fabric woven with glass fiber yarns has so far not been available on the market.

SUMMARY OF THE INVENTION

In order to remedy this deficiency, a method for the production of a fabric is disclosed in which glass fiber yarns are processed on a pattern-controlled Jacquard loom. For the warp, a glass fiber yarns with a titer of between 130 tex and 150 tex, and preferably between 139 tex and 142 tex and, for the filling, a glass fiber yarn with a titer between 190 tex and 400 tex, and preferably of 215 tex are used, the fluctuations in titer being less than ±10% and preferably less than ±7%.

DETAILED DESCRIPTION OF THE INVENTION

A method for the production of a patterned glass fabric, and in particular a patterned wallpaper having a fabric woven with glass fiber yarns, in accordance with invention is characterized by processing glass fiber yarns on a pattern-controlled Jacquard loom. For the warp, a glass fiber yarn with a titer of between 130 tex and 150 tex, and preferably between 139 tex and 142 tex and, for the filling, a glass fiber yarn with a titer between 190 tex and 400 tex, and preferably of 215 tex are used, the fluctuations in titer being less than ±10% and preferably less than ±7%.

Processing of glass fibers on Jacquard machines has never been successful previously. This is the reason why patterned glass fabrics previously were unavailable. However, very extensive experiments, on which the present invention is based, show that patterned glass fabrics can be produced after all by adhering to the above-addressed limiting values, especially the very narrow fluctuations in titer, that is, in the weight of 1,000 meters of the glass fiber yarn used. In this connection, the filling density should be between 30 and 80 threads per 10 cm and preferably about 50 threads per 10 cm. At a filling density below about 30 threads per 10 cm, the fabric becomes completely flat and Jacquard structuring is hardly visible any more. If the filling density is too high and lies within the range of about 80 filling threads per 10 cm of fabric, problems arise with the weaving properties and warp breakages occur more frequently.

The inventive processing of glass fiber yarns on a pattern-controlled Jacquard loom should also advantageously be carried out with a high warp density of between 40 and 100, and preferably of 80 threads per 10 cm.

An appreciable improvement in the visibility of the Jacquard structuring arises in a further development of the invention, also owing to the fact that the degree of texture of the warp yarns is significantly less than the degree of texture of the filling yarns.

It has heretofore been extremely difficult to dye glass fiber yarns and, even then, in only a few colors. Of course, there can be dyeing only if the glass, of which the filaments of the basic fibers for the glass fiber yarn consist, are dyed appropriately. In view of the fact that the thickness of the filaments is extremely small, being of the order of a few micrometers, even a dark shade of the glass starting material is no more effective than the corresponding coloration of the filament and, with that, of the finished yarn.

In order to nevertheless be able to use colored, patterned glass fabrics, provisions are made in a further development of the inventive method so that colored synthetic resin yarns are also mixed with the glass fiber yarns, especially for the filling, in addition to the basic fibers of glass filaments. For example, a mixed yarn, containing a proportion of incombustible polyester (Trevira CS) can be used for the filling threads.

The heavy shade dyeing of the synthetic resin fibers confers any color desired on the mixed glass fiber yarn. Due to the high proportion of glass fiber filaments, which preferably should be appreciably above 50%, and due to the use of special incombustible synthetic resins, the advantageous properties of a glass fabric are retained also by these mixed yarns.

The finished, patterned fabric can then be coated in a known manner with a mixture of starch and synthetic resin.

When the preferred glass fiber yarn is used for the filling yarns with a titer of 215 tex, a glass fiber yarn consisting, for example, of three basic fibers with, in each case, 66 tex and a filament diameter of 9 $\mu$m, is used. On the other hand, for a glass fiber yarn of 390 tex, which still lies within the titer limits given, the yarn is constructed on the basis of five basic fibers of 71 tex with a filament diameter of 9 $\mu$m or 10.5 $\mu$m. It is not possible to differentiate optically between the alternative filament diameters given and the different filaments lead to practically one and the same product with 390 tex.

Having described preferred embodiments of the invention, it is to be understood that the invention is not limited to those precise embodiments, and that various changes and modifications may be effected therein by one skilled in the art without departing from the scope or spirit of the invention as defined in the appended claims.

What is claimed is:

1. A method of making a patterned glass fabric comprising the following steps:

providing a pattern controlled Jacquard loom, using a glass fiber warp yarn with a titer between 130 to about 150 tex, using a glass fiber filling yarn with a titer between 190 to about 400 tex, and;

using glass fiber warp yarn and glass fiber filling yarn having fluctuations in their titers no greater than about ±10%.

2. The method according to claim 1, wherein the titer of the glass fiber warp yarn is between about 139 to about 142 tex.

3. The method according to claim 1, wherein the titer of the glass fiber filling yarn is about 215 tex.

4. The method according to claim 1, wherein the fluctuations in titer are about ±7%.

5. The method according to claim 1, comprising the further step of using a high warp density of between about 40 to about 100 threads per 10 cm.

6. The method according to claim 5, comprising the further step of using a filling density between about 30 to about 80 threads per 10 cm.

7. The method according to claim 5, comprising the further step of using a filling density of about 50 threads per 10 cm.

8. The method according to claim 5, wherein the high warp density is about 80 threads per 10 cm.

9. The method according to claim 1, comprising the further step of using a filling density between about 30 to about 80 threads per 10 cm.

10. The method according to claim 1, comprising the further step of using a filling density of about 50 threads per 10 cm.

11. The method according to claim 1, wherein a degree of texture of the glass fiber warp yarn is significantly less than a degree of texture of the glass fiber filling yarn.

12. The method according to claim 1, further comprising the step of mixing colored synthetic resin fibers with the glass fiber warp yarn and glass fiber filling yarn.

13. The method according to claim 12, wherein the colored synthetic resin fibers include a proportion of incombustible polyester.

14. The method according to claim 13, wherein said incombustible polyester includes Trevira CS.

15. The method according to claim 1, further comprising the step of mixing colored synthetic resin fibers with the glass fiber filling yarn.

16. The method according to claim 1, further comprising the step of coating the patterned glass fabric with a mixture of starch and synthetic resin.

17. A glass fabric made by the method of claim 1.

18. A wallpaper made by the method of claim 1.

* * * * *